US008135309B2

(12) United States Patent
Swift et al.

(10) Patent No.: US 8,135,309 B2
(45) Date of Patent: Mar. 13, 2012

(54) COMPACT, LONG LIFE CHARGING DEVICE

(75) Inventors: Joseph A. Swift, Ontario, NY (US); Fa-Gung Fan, Fairport, NY (US); Richard W. Seyfried, Williamson, NY (US); Michael F. Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 378 days.

(21) Appl. No.: 12/472,811

(22) Filed: May 27, 2009

(65) Prior Publication Data

US 2010/0303505 A1 Dec. 2, 2010

(51) Int. Cl.
*G03G 15/20* (2006.01)

(52) U.S. Cl. ..... 399/170; 399/115; 399/168

(58) Field of Classification Search ..... 399/110, 399/115, 168, 170–173
See application file for complete search history.

(56) References Cited

U.S. PATENT DOCUMENTS

| | | | | |
|---|---|---|---|---|
| 2,777,957 | A | 4/1950 | Walkup | |
| 4,056,723 | A * | 11/1977 | Springett et al. | 250/324 |
| 4,764,675 | A | 8/1988 | Levy et al. | |
| 6,308,032 | B1 | 10/2001 | Weber et al. | |
| 2005/0214026 | A1 * | 9/2005 | Palmer et al. | 399/115 |
| 2007/0059026 | A1 * | 3/2007 | Owens | 399/100 |
| 2007/0160389 | A1 | 7/2007 | Zona et al. | |
| 2007/0235647 | A1 | 10/2007 | Zona et al. | |
| 2008/0199195 | A1 | 8/2008 | Swift et al. | |

OTHER PUBLICATIONS

Zona et al., "High Strength, Light Weight Corona Wires Using Carbon Nanotube Yarns," U.S. Appl. No. 12/062,169, filed Apr. 3, 2008.

* cited by examiner

*Primary Examiner* — David Porta
*Assistant Examiner* — Jessica L Eley
(74) *Attorney, Agent, or Firm* — Oliff & Berridge, PLC

(57) ABSTRACT

A coronode charging device includes a support member, a filament, an adjustment mechanism and a voltage source. The lament is disposed along the support member in a configuration that creates a plurality of active regions and a plurality of inactive regions of the filament. The active regions are simultaneously positionable adjacent the photoreceptor. The inactive regions may be farther from the photoreceptor than the active regions. The adjustment mechanism moves the filament such that portions of the filament that correspond to the active regions are moved to positions that correspond to the inactive regions, and some portions of the filament that were in the inactive regions are moved to positions that correspond to the active regions. This operations extends the life of the coronode charging device.

12 Claims, 14 Drawing Sheets

COMPACT, LONG LIFE CHARGING DEVICE

BACKGROUND

This invention relates to xerography. More particularly, this invention relates to corona generating devices for applying electrostatic charge onto a photoreceptor.

In the xerographic process, a photoreceptor comprising a photoconductive insulating material on a conductive backing is given a uniform electric charge over its surface and is then exposed in a pattern to be reproduced. This exposure discharges the receptor areas in accordance with the radiation intensity which reaches them and thereby creates an electrostatic latent image on or in the receptor coating which may then be developed into visible form by applying a developer material, e.g., a liquid or a powder, to the receptor using any development technique generally known and used in the art. The developer material electrostatically clings to the receptor in a visual pattern corresponding to the electrostatic image. Thereafter, the developed image is transferred from the receptor to a support material such as paper to which it may be fixed, thereby forming a permanent print.

The charging of the photoreceptor in preparation for the exposure step can be accomplished by a corona-generating device. The corona-generating device applies electrostatic charge to the photoreceptor to raise it to a potential of, e.g., approximately 500 to 1000 volts. One form of corona generating device for this purpose is disclosed in U.S. Pat. No. 2,777,957 wherein a plurality of parallel wires are connected in series to a high voltage source and are supported in a conductive shield that is arranged in closely spaced relation to the surface to be charged. When the wires are energized, corona is generated along the surface of the wires and ions are caused to be deposited on the adjacent photoconductive surface. A mechanism is usually provided to effect relative movement of the surface to be charged and the corona-generating device. Some corona generating devices may have a single corona wire instead of a plurality of wires. Designs that are more recent include a "grid" or screen spaced in between the coronode and the receptor to control the amount of ions that reach the receptor.

As described in U.S. patent application Ser. No. 12/062,169, entitled "High Strength, Light Weight Corona Wires Using Carbon Nanotube Yarns" to Zona et al., the entire disclosure of which is incorporated herein by reference, nanostructured Carbon Nano Tube (CNT) filament can be used as a linear coronode to improve upon the life and performance of the wire in conventional corotrons. A coronode is a corona-generating electrode. A corotron is a corona-generating device that is used to apply charge to a photoreceptor. From testing commercially available CNT filaments as coronode members, it was learned that these filaments facilitate corona charging similar to that of tungsten wires, and because they are lightweight and mechanically stronger than tungsten, they enable much smaller diameters than have been possible using tungsten wires.

It is also desirable in corona generating devices to provide an arrangement for easily replacing a deteriorated corona electrode with a new one. Since this replacement usually takes place at a commercial site by a service technician, ease of replacement and adjustment in a minimum amount of time is very beneficial.

However, xerographic charging devices typically suffer from short operational lives and high run costs. Others have tried to solve these problems. For example, U.S. Pat. No. 6,308,032 entitled "Rotatable Charging Apparatus, and Printing Machine Including the Same" to Weber et al., discloses a plural solid state charging devices positioned around a cylinder. An individual charging device is used for its lifetime. Then, the device rotates to expose another charging device. This use of a charging device, and then rotating to another position, is a way of indexing to achieve consistent charging uniformity for a long use period.

Existing devices, even with minor improvements, are projected to fall short of meeting life and cost objectives for future systems. At present, a variety of performance restorative cleaning mechanisms and devices have been implemented to attempt to improve life coronode-based chargers. Unfortunately, these attempted improvements have had only limited success while adding cost and complexity to the subsystem. To address the shortfall, radically different charger devices, such as a solid-state charger, have been the focus of research over the past decade where attempts were made to leverage emerging technologies to address life and cost issues.

SUMMARY

A cheaper, extended life coronode charging device includes a support member, a filament, an adjustment mechanism and a voltage source. The filament is disposed along the support member in a configuration that creates a plurality of active regions and a plurality of inactive regions of the filament. The active regions are arranged coplanar to each other and simultaneously positionable adjacent the photoreceptor. The inactive regions are farther from the photoreceptor than the active regions. The adjustment mechanism moves the filament such that portions of the filament that correspond to the active regions are moved to positions that correspond to the inactive regions, and portions of the filament that were in the inactive regions are moved to positions that correspond to the active regions.

In some embodiments, the support member includes a rotatable shaft and an external thread disposed along the shaft in a spiral shape. Here, the filament is wrapped around the shaft and may be disposed in a groove defined by the external thread. The thread may have flat edges that expose the wrapped nanotubular filament. The flat edges have a relationship wherein a distance from a center of the shaft to an outer perimeter of the wrapped filament is greater than a distance from the center of the shaft to at least a part of the flat edges.

In some embodiments, a coronode device includes a supporting substrate that is positioned between the photoreceptor and the filament and an array of apertures disposed in the supporting substrate. Active regions of the filament are exposed to the photoreceptor at each aperture in the supporting substrate. The filament may include multiple filaments with each aperture corresponding to one of the active regions.

In some embodiments, the support member may include a plurality of first pivot support structures disposed closer to the photoreceptor than a plurality of second pivot support structures. In this embodiment, the active regions are at the first pivot support structures. This embodiment may further include a spring, a first wheel and a second wheel, wherein the spring is connected to the first wheel, and the filament contacts the first and second wheels, and is held taut by action of the spring.

In some embodiments, two coronode devices are disposed such that the filament of a first one of the devices directly contacts the filament of a second one of the devices at a contact point, the contact causing friction that removes material that has been built up on the filaments of the two devices.

In some embodiments, the two-coronode devices extend in a parallel direction where the first device and the second device are at an equal distance from the photoreceptor. In these embodiments, the filament of the first device may contact the filament of the second device at least one contact point. The contact causes friction that removes material that has been built up on the filaments of the first device and the second device.

A xerography device or a photocopier may use the above coronode charging devices.

Also, a method is provided for indexing a coronode charging device in a way that extends the life of the coronode charging device. The method includes the step of using an adjusting mechanism to replace the active regions that have become exhausted by a buildup of material with inactive regions that have not become exhausted. In some embodiments, the adjustment mechanism moves the filament without moving the support member.

In some embodiments, the adjustment mechanism moves the support member. In some embodiments, the method includes the step of rotating the support member. In some embodiments, the method may further include a step of removing the buildup of material from the active regions that have become exhausted by a buildup of material.

In some embodiments, the active regions are closer to the photoreceptor than the inactive regions, and the active regions cease to be active once they have been replaced.

BRIEF DESCRIPTION OF THE DRAWINGS

Exemplary embodiments will be described with reference to the drawings, wherein like numerals represent like parts, and wherein.

EMBODIMENTS

Figure 1:
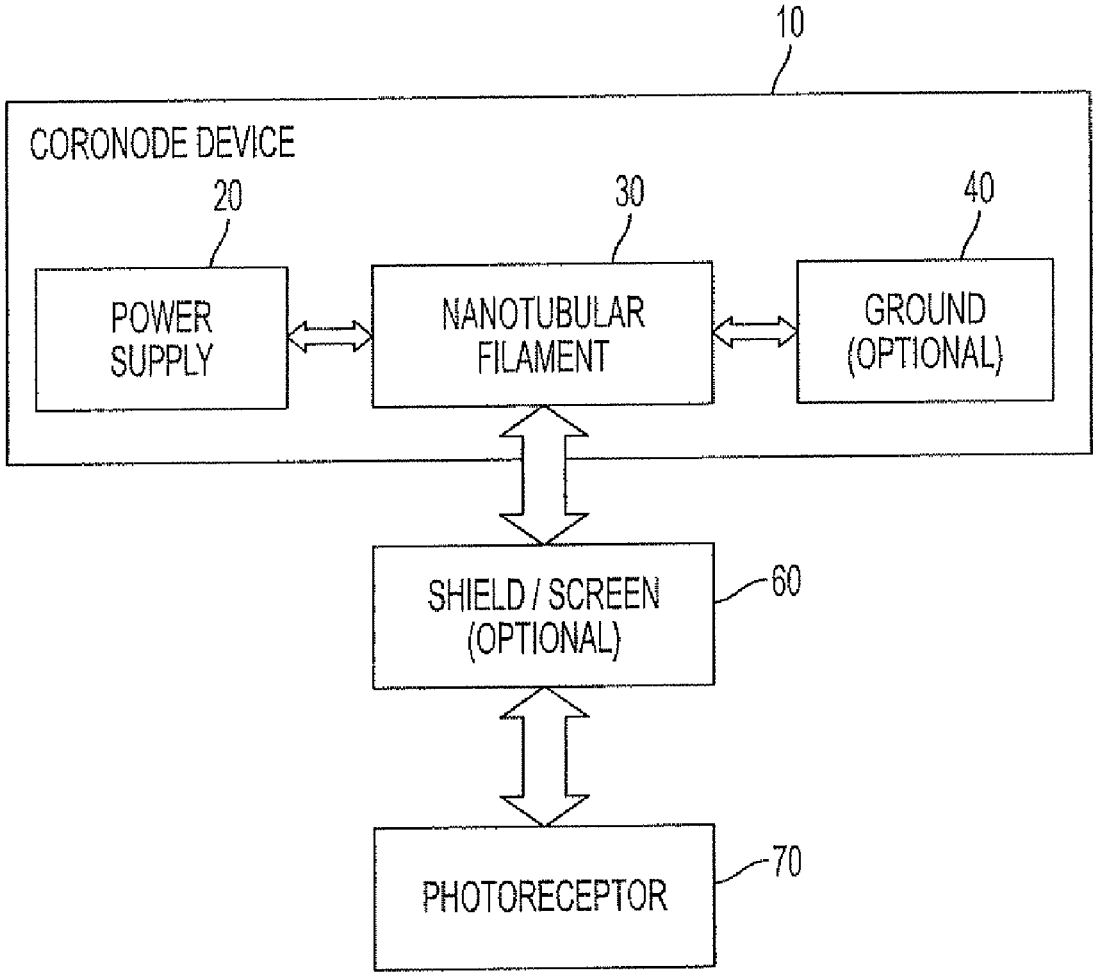
FIG. 1 is a functional block diagram illustrating an exemplary embodiment of a coronode device.

A very recent attempt to deploy Carbon Nano Tube ("CNT") filaments as coronodes resulted in discovery of a new non-uniformity problem that is believed to be due to the non-uniform structure of the filament. Charge density non-uniformities can be seen in the surface potential scans of receptors charged by prototype devices. Perturbations in the corona plasma generated by the CNT filament are believed to originate from non-uniformities that are inherent within the filament structure which is, at least at the present time, characteristic of the commercially available CNT filaments.

Contamination via silicate formation is the failure mode that dominates coronode devices that operate in or around the active corona plasma regions. In addition, inactive coronode regions or members residing away from the corona plasma of an operational element do not form silicate growths.

A compact, long life charger member is proposed that features a coronode member as a movable element where only a relatively small portion of the element's surface, e.g., from about 0.1% to about 10%, is active during a pre-established duty interval, e.g., 100,000 or 200,000 charging cycles. By employing an advanced pin-like, field tailoring coronode design coupled with a "use and move-to-replace" or a "use, move-to-clean, and move-to-replace" methodology, which are described below, the desired long operational lives and related low ran costs can readily be achieved.

Specifically, an advanced coronode material comprising a very thin and strong wire or filament is proposed as a moveable coronode element along with several design embodiments. Nanotube yarns in which individual nanotubes are woven together can be used as a nanotubular filament. Specific filament materials may be carbon, boron nitride, doped silica, or other suitable electroconductive filaments. The wire materials include, but are not limited to, tungsten, platinum, or other nobel metal wires. The diameter of the wire or filament is greater than about 10 microns, but less than about 50 microns, and preferably less than about 30 microns, in order to enable the use of low excitation fields (e.g., <10 Volts/nm of filament length) provided by linear coronodes that have a small radius of curvature and a relatively small spacing between the coronode device and the photoreceptor. This is in contrast to a conventional wire coronode device that requires 12-20 Volts/mm of wire length in order to provide enough current to ionize air molecules for proper device charging. Air breakdown (arcing) between the coronode and surrounding device features occurs at around 1 kV/nm spacing. By lowering the operating voltage, it is possible to reduce the spacing, and thus create smaller charge devices. The high mechanical and thermal strength, flexibility, conductivity, and durability provided by these filaments and wires offer substantial benefits in the proposed designs. For convenience, the term "filament" will be understood to refer to and encompass both filaments and wires.

Thus, a variety of embodiments that can be fabricated into very compact devices are disclosed. These embodiments selectively activate portions of the nanostructured coronode to produce uniform charge on the photoreceptor. A selected portion remains in use until it is determined to be contaminated, or predicted to be contaminated based on empirical studies conducted in advance. A short-interval indexing movement is then used to replace the exhausted present active region with an unused, uncontaminated ("non-exhausted") region of the coronode member.

This indexing movement does not require a complete replacement of the coronode filament or the coronode device. For example, if the coronode device is 16 inches long and the length of coronode filament is 16 inches long, the 16 inches of the coronode filament does not need to be replaced when performance deteriorates. Instead, a small portion, e.g., ¼ inch, may be replaced. In this indexing method, the life of the device can be established in advance. The number of used incremental indices can be counted to determine the total life, used life, and/or life of the coronode remaining, and a sensor is therefore not required to determine the end of the service life of the coronode.

The extent to which the life of the of the coronode in exemplary embodiments disclosed herein can be extended is a function of (1) the ratio of the coronode area that is in active use ("in-use area") to the unused area, and (2) the characteristic life (i.e., the life that can be expected, as determined by testing of samples in advance) of the in-use area. Modeling of characteristic life of the indexing nanostructure coronode regions described below reveals that life extensions of many orders of magnitude are possible. Thus, the coronode materials, structures, and/or operational methodologies described below enable extremely long-life, compact charging systems that will be valued by future products.

Exemplary embodiments address problems known with prior art devices and are distinguishable from prior devices in one or more of the following ways: (1) the exemplary embodiments do not employ "solid state" thick- or thin-film designs; (2) the exemplary embodiments do not require imbedded heaters to obtain acceptable charge densities or uniformities; (3) the coronode materials, properties, incremental indexing and/or designs are unique; (4) the motion mechanics are unique; (5) coronode cleaners are not required for a long service life; and/or (6) the integration of specific coronode configurations and field profiling to obtain effective corona-charging behavior overcomes the new problem with non-uniform CNT structures.

FIG. 1 is a functional block diagram of a coronode device 10. The coronode device 10 is disposed in proximity to a photoreceptor 70. The coronode device 10 includes a power supply 20, a nanotubular filament 30, an optional ground 40 and an optional shield or screen 60.

The nanotubular filament 30 is disposed on a support member (not depicted). Materials for the support member are typically insulators, and may be polymeric, ceramic, or other types of insulative materials. Examples include, but are not limited to, silicone and textiles. Moldability is desirable. The power supply 20 provides a high voltage through an end block (described below) that is electrically connected to the nanotubular filament 30.

Figure 2:
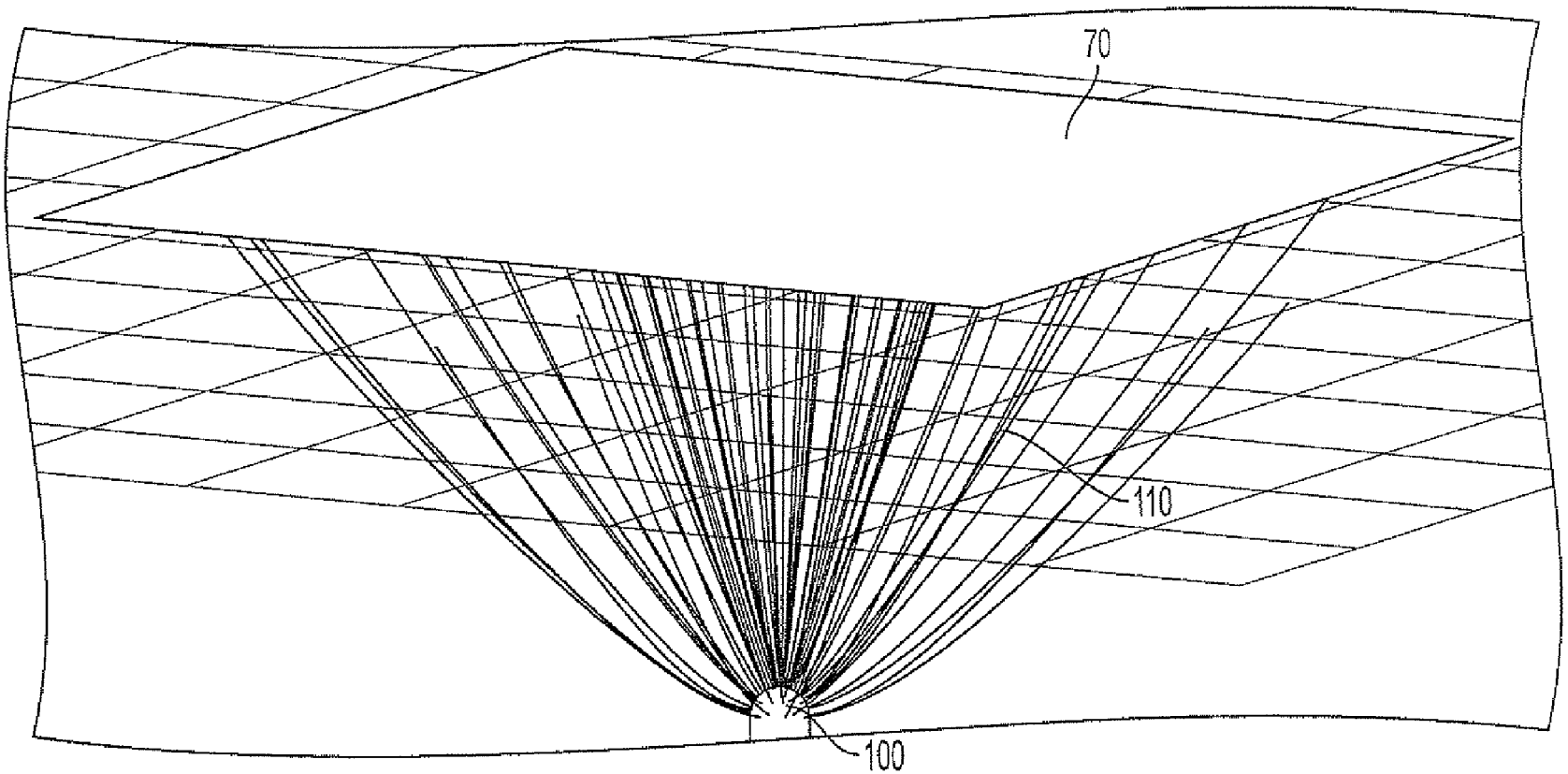
FIG. 2 is a model of the flux emanating from an active region charging the photoreceptor.

FIG. 2 illustrates how a point source 100 uses a coronode discharge 110 to create an electric field and deposit charge on a proximate area of the photoreceptor 70. Here, the discharge is in a generally conical shape.

Figure 3:
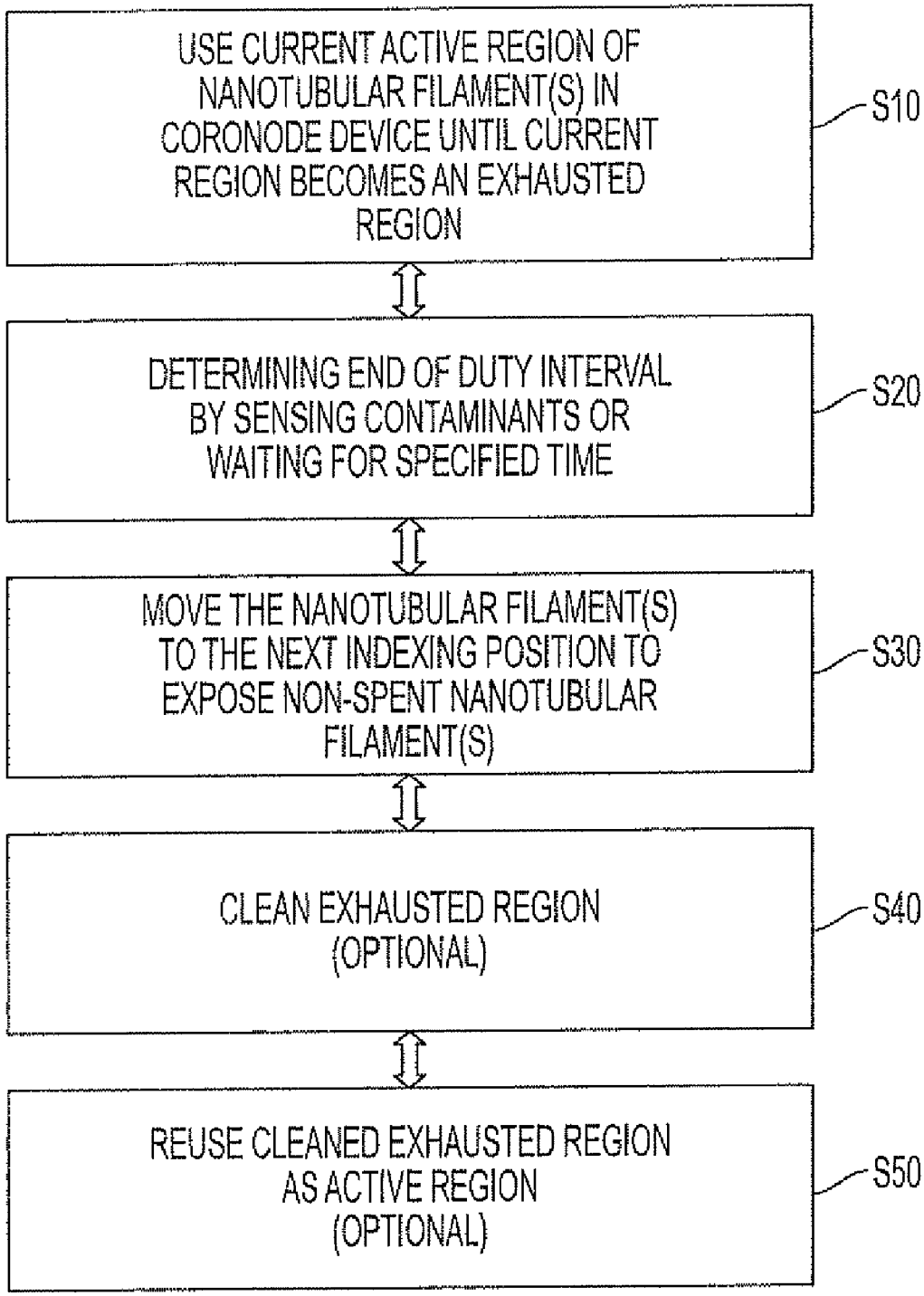
FIG. 3 is a flowchart illustrating a first exemplary indexing method.

FIG. 3 illustrates "use and move" and "use, move and replace" indexing methods. In step S10, the coronode deposits its charge using an active region (described below) of one or more filaments to charge a photoreceptor. The corona discharge causes a breakdown in air surrounding the coronode, creating by-products such as ammonia, noxious oxides, etc. Over time, unwanted deposits including silicates deposit on the nanotubular filament in the active region 80, creating non-uniformities. As described above, a coronode device exhibiting non-uniformities ("exhausted") in the active regions does not perform as well as unused or non-exhausted regions of nanotubular filaments. In step S20, the end of the duty interval for the active region is determined by sensing the wire to detect non-uniformities and buildup of deposits, or by waiting a specified time, e.g., 50,000 to 200,000 charging cycles.

After it is determined that the active region has been exhausted in step S20, the nanotubular filament is moved to the next short-interval indexed position in step S30. At this position, a non-exhausted (e.g., unused or gently used) region of the nanotubular filament becomes the new active region. This region does not contain significant amounts of the silicate deposits that adversely affect coronode uniformity performance. The "use and move-to-replace" method includes steps S10-S30 until the entire filament has been exhausted to create a long useable life of the device. However, the nanotubular filament that has been exhausted, or the portions thereof, may be cleaned in optional step S40. After cleaning, the cleaned, previously exhausted regions can then be reused as the active region in step S50 to extend the useable life of the device. The "use, move-to-clean, and move-to-replace" method includes steps S10-S50.

FIGS. 4-8 illustrate exemplary embodiments in which a filamentary coronode is coupled with a supporting member. Indexing in these embodiments is performed by rotating the support member enables selected regions of the filament to become active when brought into proper alignment with a charge receptor.

Figure 4:
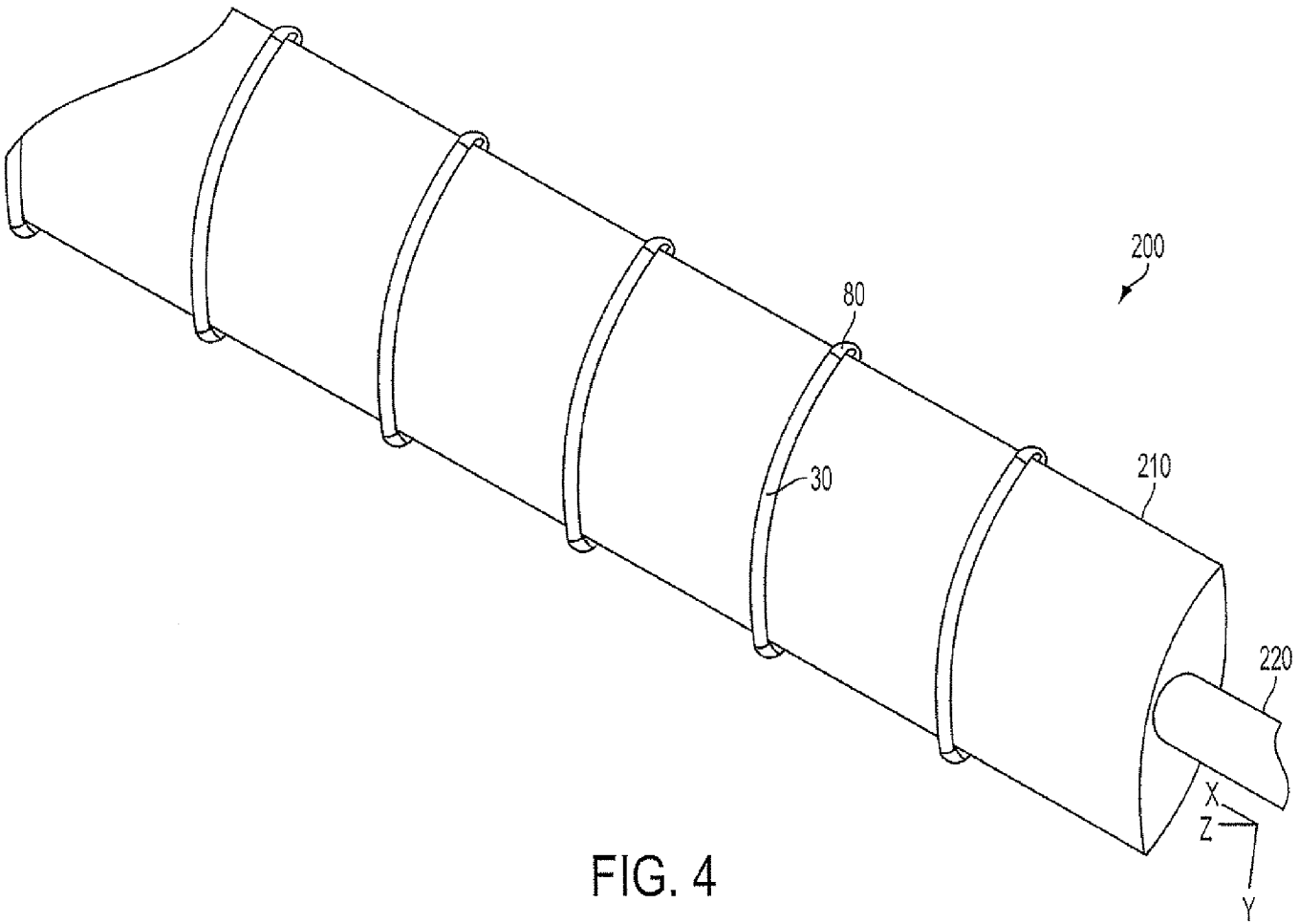
FIG. 4 illustrates a first exemplary embodiment of a coronode device.

Coronode device 200 is a specific example of the device 30 shown in FIG. 1. FIG. 4 shows an exemplary embodiment of coronode device 200. The coronode device 200 has a nanotubular filament 30 fixedly wrapped around a support member 210 having an football-shaped cross-sectional area. Instead of being cylindrical, this cross-sectional area has two "pinched" endpoints. The support member 210 has two index positions, one at each "pinched" endpoint of the cross-sectional area.

In operation, the coronode device 200 is used for a given number of charging cycles, then indexed to a new position (i.e., in this case, rotated 180 degrees by the motor to a new position) so that different portions of the filament are adjacent to the photoreceptor (not depicted). To index the coronode to the next active region, a spindle 220 rotates the support member 210. The spindle 220 may be connected to an external motor. Alternatively, it is possible to fix the support member 210 and incrementally move the nanotubular filament 30 around the support member 210. In this way, more than two index positions are possible.

Additionally, a second nanotubular filament (not depicted) may be wrapped around the support member 210 in such a way that the second nanotubular filament is parallel to the nanotubular filament 30. Such a design in motion would look like a barber's red and white pole.

Figure 5:
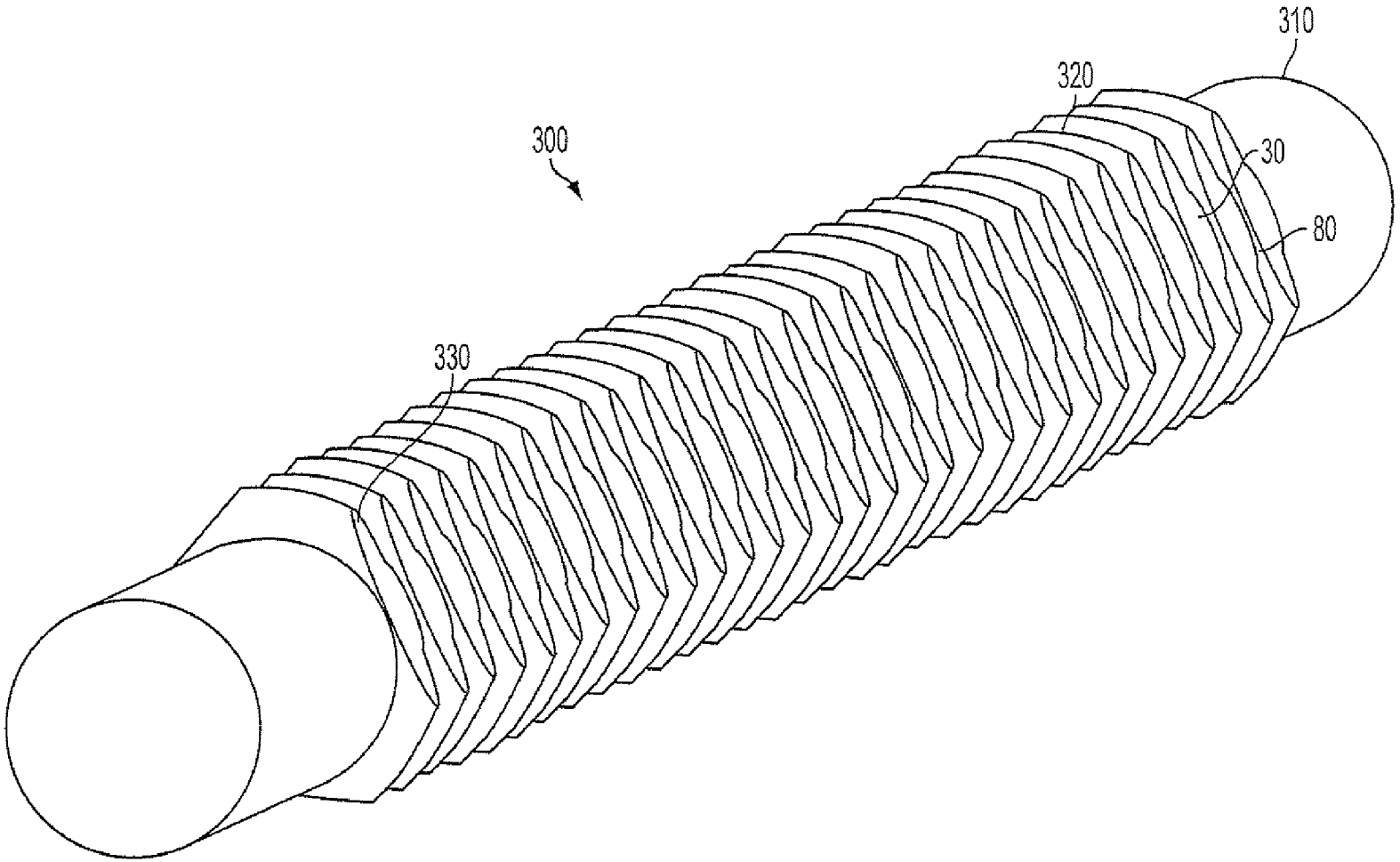
FIG. 5 illustrates a second exemplary embodiment of a coronode device.

Coronode device 300 is a specific example of the device 30 shown in FIG. 1. FIG. 5 shows an exemplary embodiment of coronode device 300. The coronode device 300 has a support member 310, which differs from the support member 210 in that the support member 310 is shaped like a screw with threads 320. The threads have any number of flat areas 330. For example, in FIG. 5, threads 320 have three flat areas 330. Each flat area 330 corresponds to a rotatable index. The flat areas can be created by, for example, making the screw-like shape, and then trimming or shaving the threads to create the flat areas. The nanotubular filament 30 is wrapped around the screw-like support member 310. Near the flat areas 330, the wrapped nanotubular filament 30 is exposed. When one of these exposed regions is at the apex of the support member closest to the photoreceptor 70, the exposed nanotubular filament 30 area becomes the active region 80.

Figure 6:
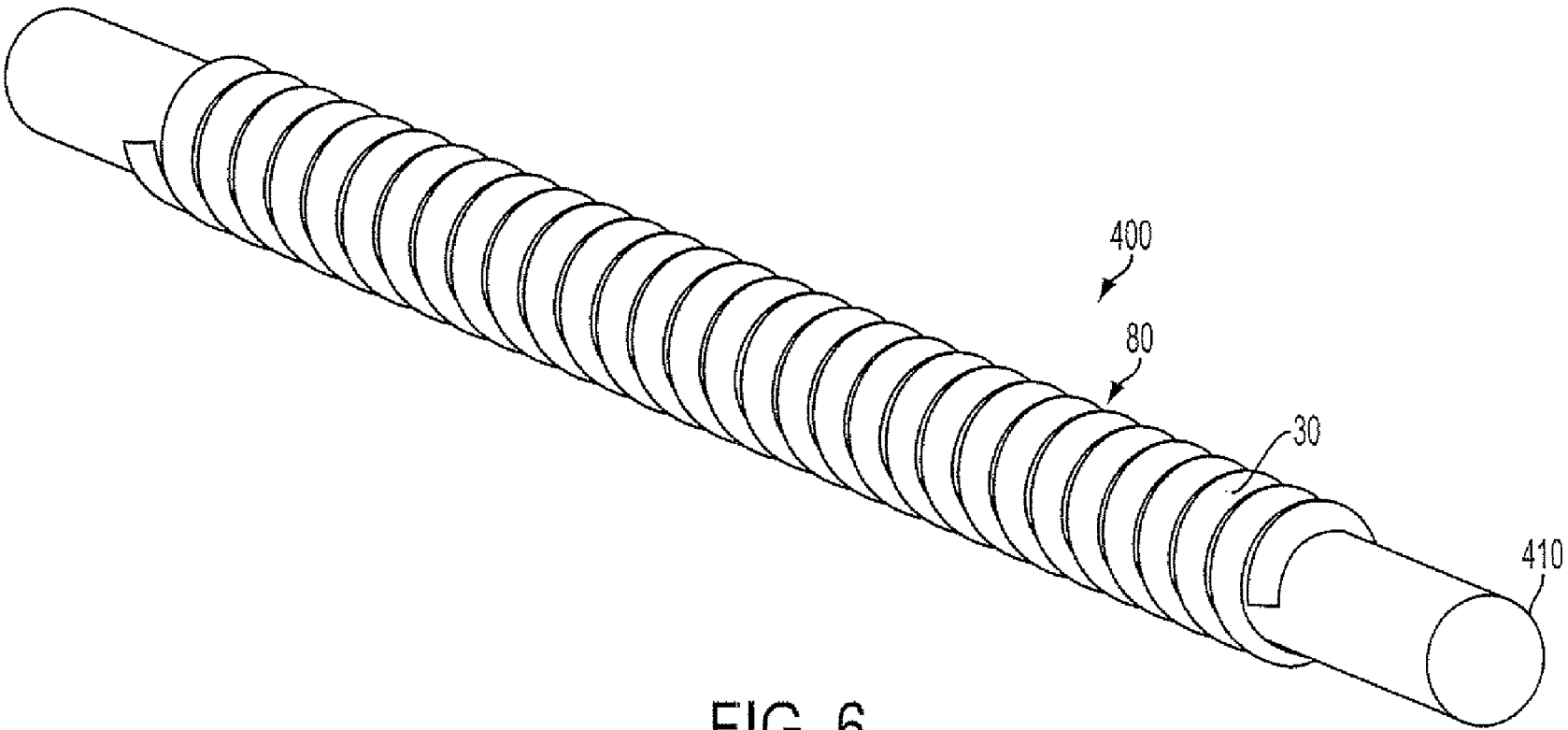
FIG. 6 illustrates a third exemplary embodiment of a coronode device.

Coronode device 400 is a specific example of the device 30 shown in FIG. 1. FIG. 6 shows an exemplary embodiment of coronode device 400. A coronode device 400 is similar to the coronode device 200, except that the wrapped nanotubular filament 30, wrapped on a support member 410, is much more tightly wound than that of the device 200, and the cross-sectional area of the support member 410 is cylindrical. Separation, e.g., 1.5 to 2 mm, between each coil prevents modification of the field lines between the respective active regions and the photoreceptor. Alternatively, an insulative material can be used to separate the coils. The support member 410 may have grooves in which lies the nanotubular filament 30. Similar to device 200, the active regions 80 are at the regions closest to the photoreceptor 70. Similar to the exemplary embodiments shown in FIGS. 4 and 5, the indexing here is also performed through rotating. Around the circumference of the nanotubular filament-wrapped support member 410 are n indexed positions (e.g., n=2, 10, 25, 50, 75, 100, or any desired number). As such, each partial rotation (360 degrees/n) of support member 410 places a different region of the nanotubular filament 30 in proximity to the photoreceptor 70 to create a new active region 80.

Figure 7:
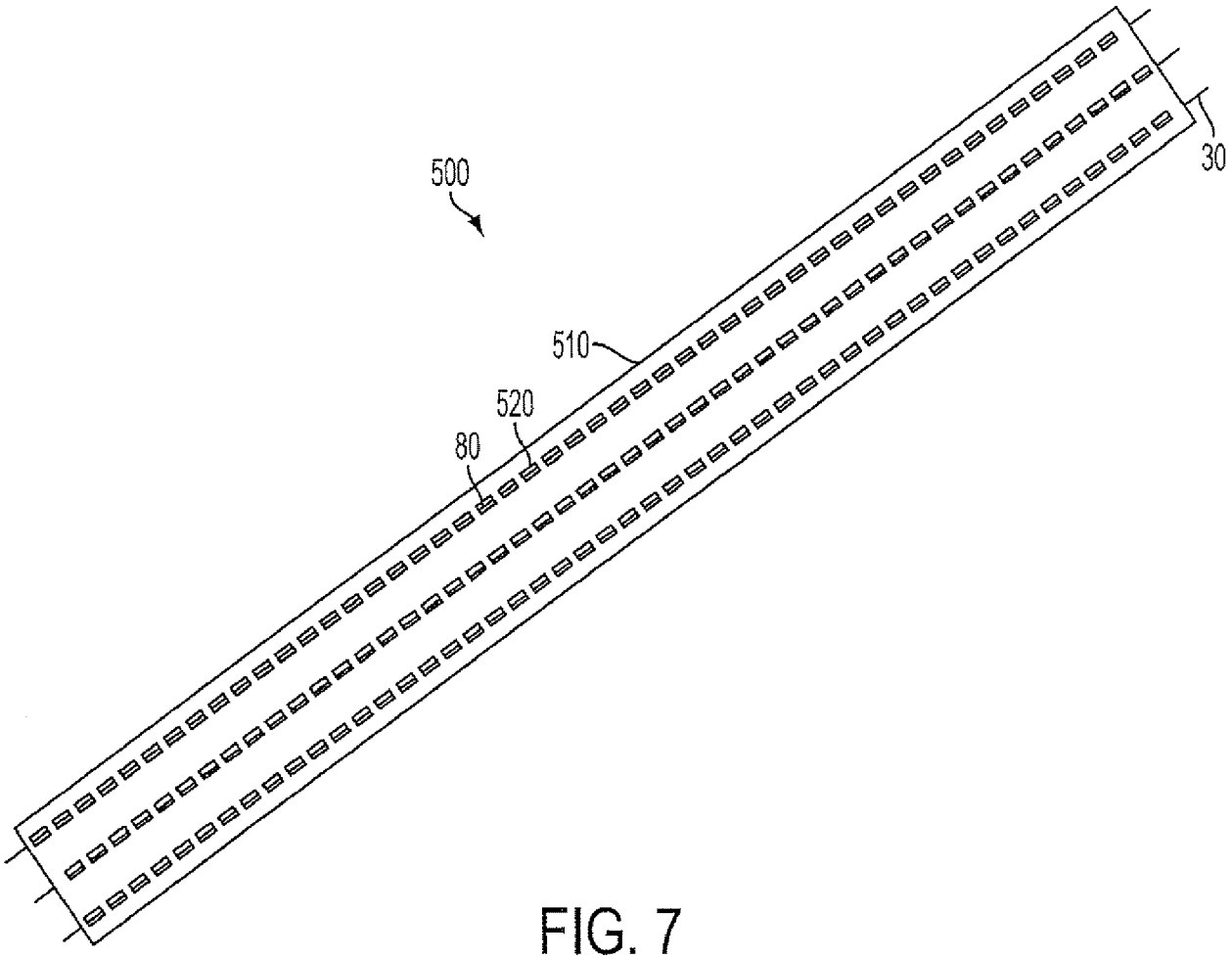
FIG. 7 illustrates a fourth exemplary embodiment of a coronode device.
Figure 8:
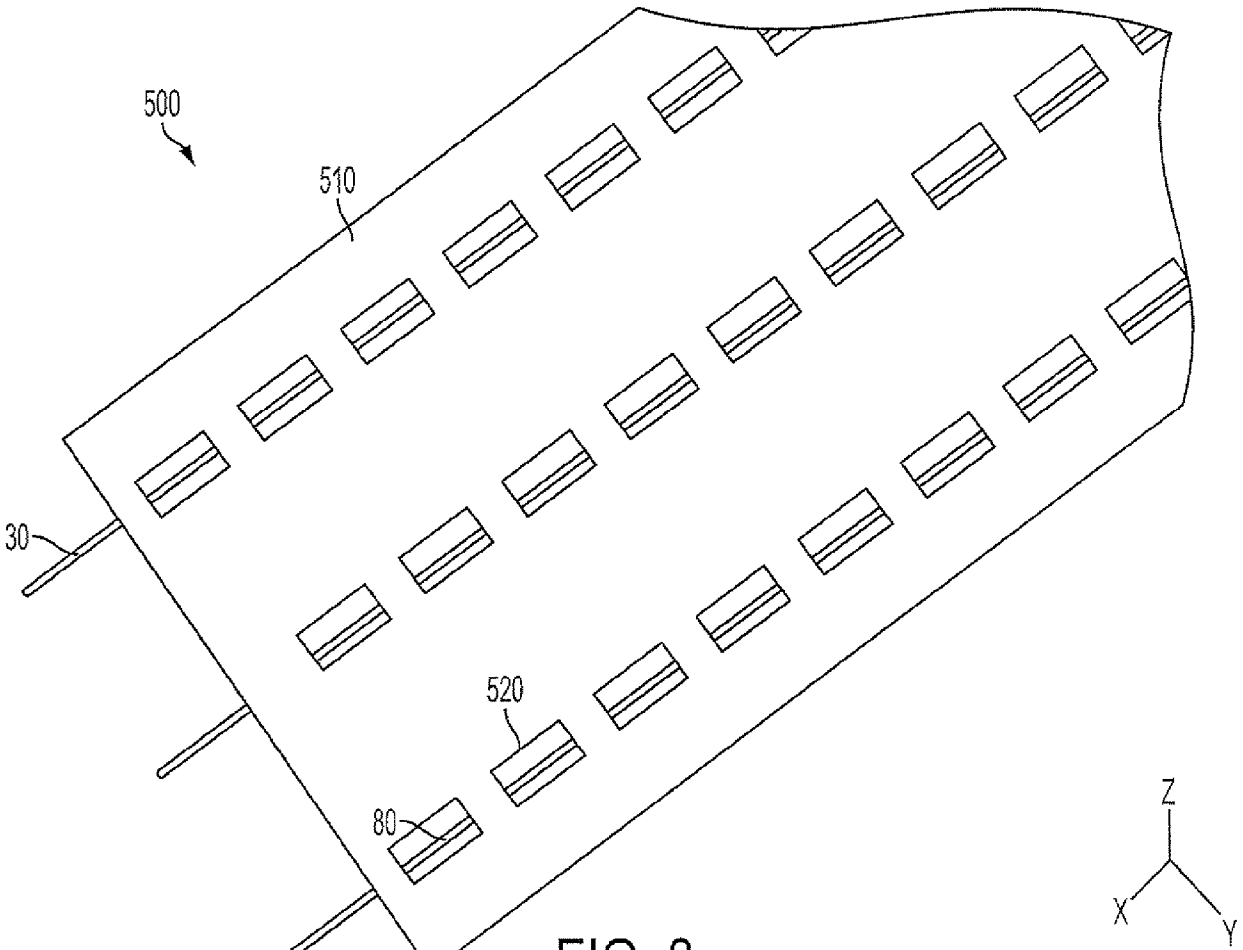
FIG. 8 is an enlargement of FIG. 7.

Coronode device 500 is a specific example of the coronode device 10 shown in FIG. 1. FIGS. 7 and 8 show an exemplary embodiment of coronode device 500. FIGS. 7 and 8 illustrate another exemplary embodiment of a coronode device 500 in a flat array comprising a large number of ion-generating apertures 520 arranged in operational rows that form a two-dimensional pattern on a supporting substrate 510. FIG. 8 is a close-up enlarged view of the coronode device 500 of FIG. 7. Coronode device 500 includes a variable number of nanotubular filaments 30 disposed on a side of the supporting substrate 510 opposite to the photoreceptor 70, parallel to the supporting substrate 510. Each nanotubular filament 30 may be configured to pass across a single row of apertures 520. The supporting substrate 510, at least at the regions surrounding the apertures 520, comprises a two-layer metal-on-insulator structure. The outer metal layer facing the photoreceptor can be any nobel metal or similarly conductive material. By applying a voltage separate from the coronode at a much lower magnitude, the amount of ions that reach the photoreceptor can be controlled to provide a means of controlling the final voltage of the charged receptor. The insulating layer between the coronode filament and the metal layer can be any high dielectric insulating material, e.g., ceramic, Bakelite, phenolic, etc. The metal layer controls the charged voltage of the photoreceptor. The insulator prevents arcing between the coronode and the metal layer. This configuration is similar to a solid-state charger that uses a flat configuration of arrayed apertures. The portions of the nanotubular filaments 30 that are exposed by the apertures 520 become active regions 80. The apertures 520 can also be staggered. The distance between apertures 520 and the layout among apertures 520 can be adjusted for different applications.

To index the coronode device, either the supporting substrate 510 can be moved parallel to the direction of the extended nanotubular filaments 30, or the nanotubular filaments 30 can be moved, e.g., on a wheel. In FIGS. 7 and 8, a support structure (such as that described below in connection with FIGS. 9-11) may be connected at either side of each filament to hold the filament taut and control its movement. In FIG. 8, the enlargement illustrates more clearly the exposed active regions 80 of the nanotubular filament 30 in the apertures 520.

Figure 9:
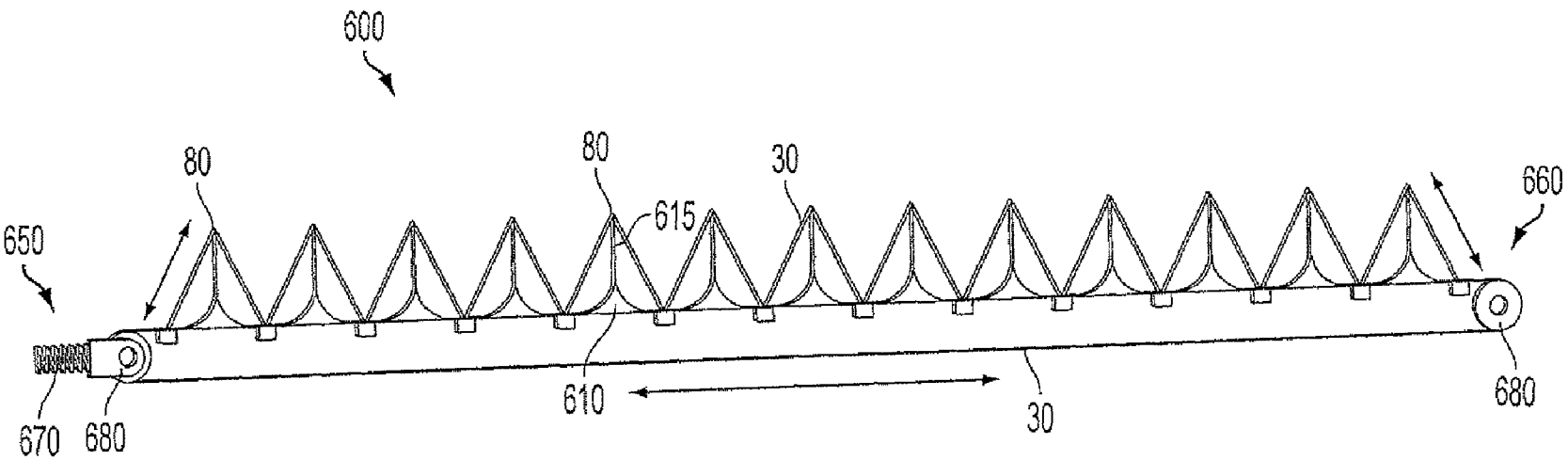
FIG. 9 illustrates a fifth exemplary embodiment of a coronode device.
Figure 10:
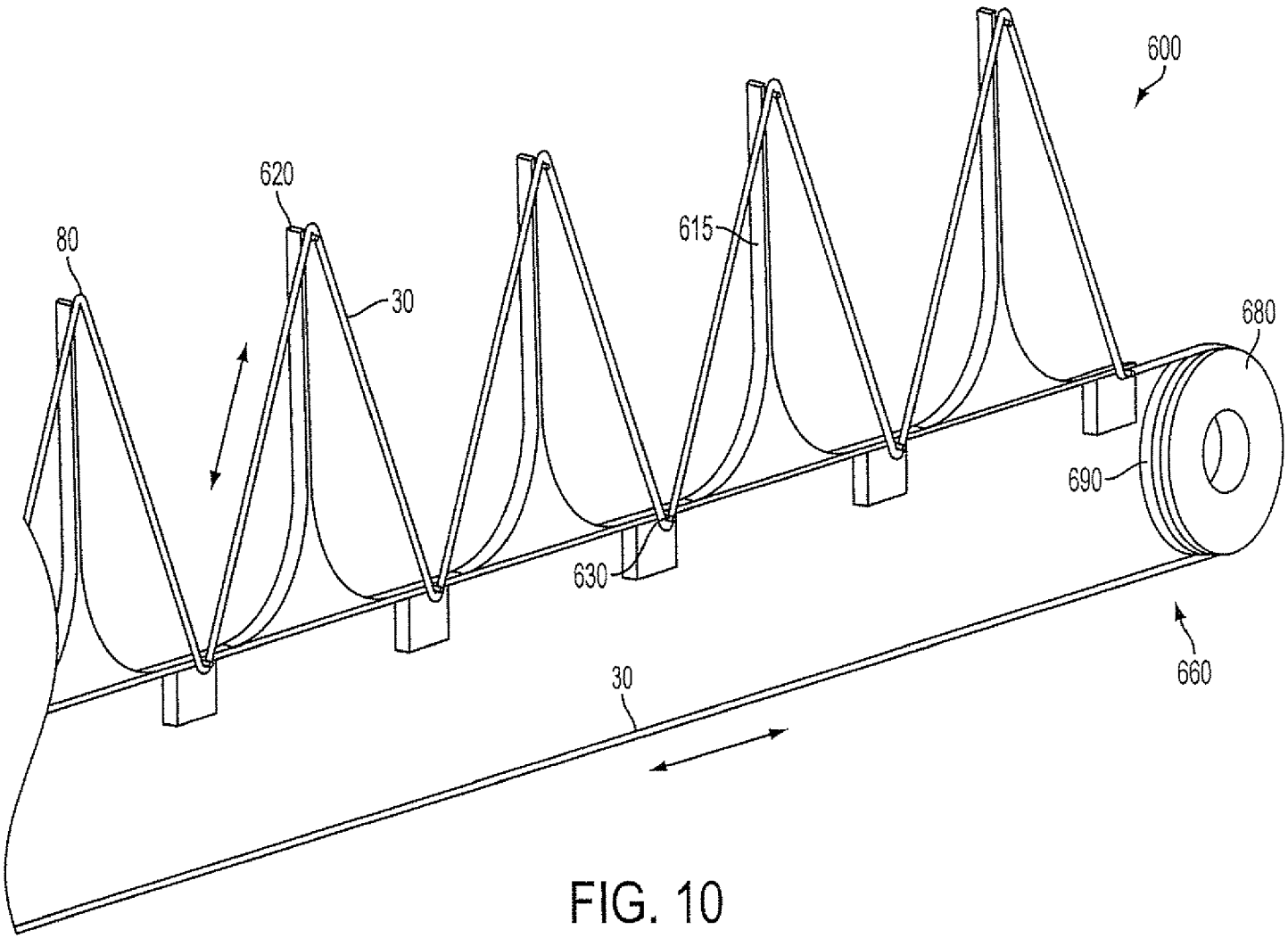
FIG. 10 is an enlargement of a portion of FIG. 9.
Figure 11:
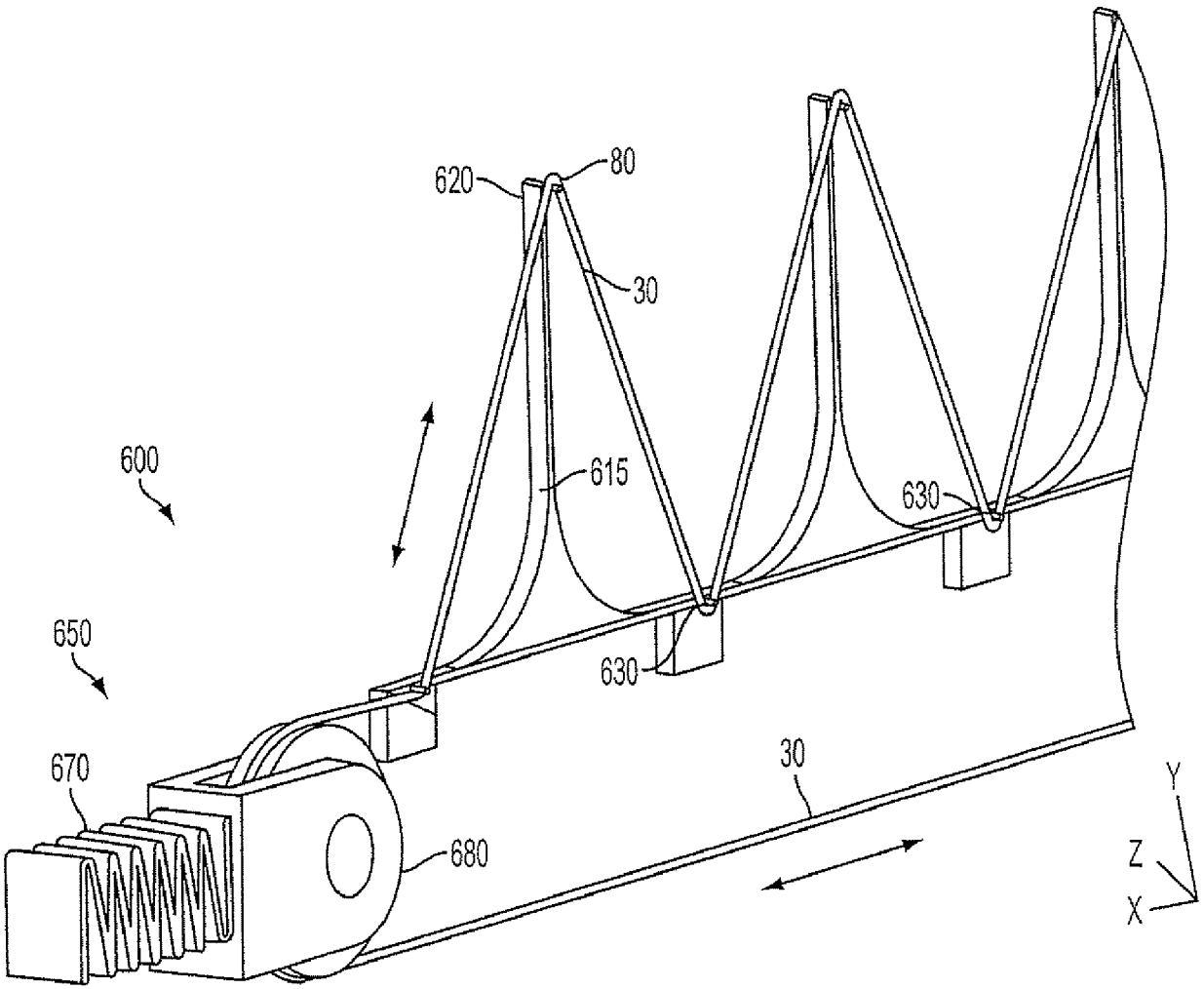
FIG. 11 is an enlargement of another portion of FIG. 9.

Coronode device 600 is a specific example of the coronode device 10 shown in FIG. 1. FIGS. 9-11 show an exemplary embodiment of coronode device 500. An exemplary saw-tooth-shaped coronode device 600 is shown including a support member 610, a first end block 650 and a second end block 660. A relatively long length of the nanotubular filament 30 is wrapped around supporting pins 615 or other suitable elements of support member 610 to create spaced-apart apex regions, which are the exposed active regions 80 in this example. These apex regions can be at various distances, e.g., 2 or 3 millimeters apart, depending on the configuration of the coronode device and the photoreceptor area to be covered. The height of the saw tooth regions may be, e.g., 2 millimeters.

The flexible nanotubular filament 30 moves along the path defined by the array of pivots on support member 610, and rollers in end blocks 650 and 660. The nanotubular filament 30 is disposed on the support member 610 and end blocks 650 and 660. End block 650 comprises a tension spring 670 and a wheel 680. End block 660 includes a wheel 680. The end blocks 650 and 660 optionally may include a filament cleaner (not depicted) that cleans the nanotubular filament as it passes through. This cleaning may be accomplished using fiber brushes, abrasive pads, or foam pads to encompass and scrape the entire circumference of the filament as it passes through the cleaning station.

Factors that control corona output and charging performance may include the radius of curvature at the apex, the altitude of the apex from the base, the entrance and exit angles that form the legs of the angle, the distance between adjoining apexes, the tension applied to the filament, the magnitude and frequency of the applied bias current, and the distance between the sawtooth tips and the receptor.

Because the configuration of FIGS. 9-11 is quite similar to the conventional pin coronodes that are used in existing scorotrons and discorotrons (i.e., other devices that use coronodes), many of the geometric aspects used therein are directly applicable here. However, unlike existing pin coronodes that use rigid metal, fixed-position active regions, movement of the flexible nanotubular filament 30 is possible in this design along the directions indicated by the arrow in FIG. 9. This movement enables renewal of the tip-most region by simple movement and indexing of the filament. This "use-and-move-to-replace" methodology may continue until the entire length of filament has been exhausted. A tension spring-based tensioning apparatus 670 is shown in end block 650 as an exemplary mechanism for applying the required tension to the entire length of filament, which in this embodiment is shown to be configured into a continuous loop. In operation, the part of the filament comprising an end-most apex region would be activated for a pre-established time (e.g., 90% of the characteristic life) and then moved to a new position just outside (in the downstream direction) of the apex region and replaced by a non-exhausted portion of the nanotubular filament 30. The power supply is connected to the filament through the spring 670 and the wheel assembly 680, both of which are made from conductive materials. The spring is affixed to a metal contact in the end block of the charge device (not shown) to allow connection to a power supply external to the coronode device.

FIG. 10 is a close-up enlarged view of the end block 660 side of coronode device 600. Here the nanotubular filament and the indexing will be more closely described in relation to the structure of support member 610, which includes first pivot support structures 620 and second pivot support structures 630. The first pivot support structures 620 and second pivot support structures 630 can include, e.g., micro pulleys, a tube surrounding the wire, a molded device such as a low-friction block, etc.

As can be seen in FIG. 10, the nanotubular filament 30 moves between the first pivot support structures 620 and the second pivot support structures 630. The active regions 80 are above the first pivot support structures 620 and are the closest points to the photoreceptor 70. To index the coronode device 600, the nanotubular filament 30 is moved so the exhausted active region over first pivot support structure 620 is replaced by an adjacent non-exhausted region of the nanotubular filament 30. The exhausted region moves off of the apex and moves closer to the second pivot support structure 630.

Protective sheaths or tubes may enclose or partially enclose the nanotubular filament 30 around the pivot support structures 620 and 630. For example, at the first pivot support structure 620, the active region 80 of the nanotubular filament 30 would be exposed to the photoreceptor 70. However, an insulative sheath would protect the nanotubular filament 30 from damage by the first pivot support structure 620.

FIG. 11 shows an enlarged view of coronode device 600, focusing on the first end block 650 side of coronode device 600. Here, the first end block 650 includes the tension spring 670 and the wheel 680. The tension spring 670 holds the nanotubular filament 30 taut as it is disposed on the support member 610. The first end block 650 may also include a wire cleaner (not depicted).

Figure 12:
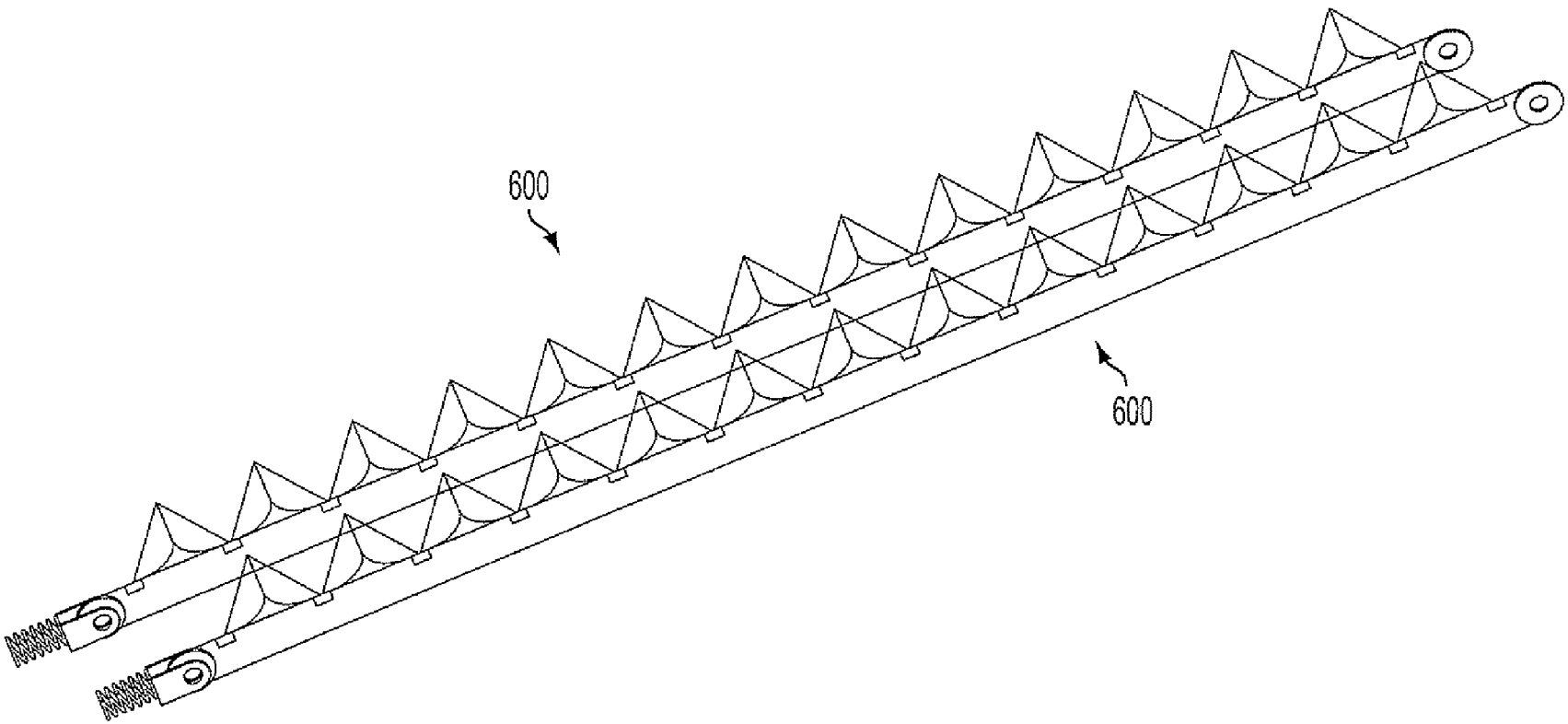
FIG. 12 illustrates a sixth exemplary embodiment, which is a combination of multiple coronode devices of the fifth exemplary embodiment that are staggered.

FIG. 12 shows two coronode devices 600 facing in the same direction and arranged so that they are staggered. As shown in FIG. 2, the coronode discharge has an electric field over a specific area of the photoreceptor that spreads from the point source of the active region. The apex regions of each are offset such that the apex of one fills in the gap of the other. The staggered coronode devices 600 are arranged such that the coronode discharge areas from the individual points can better cover the entire photoreceptor. This configuration enables higher charge densities and the opportunity to improve the overall charge uniformity of the integrated coronode devices. This scheme may provide a solution to any charge uniformity problems that may stem from non-uniformities within the structure of the filaments.

Figure 13:
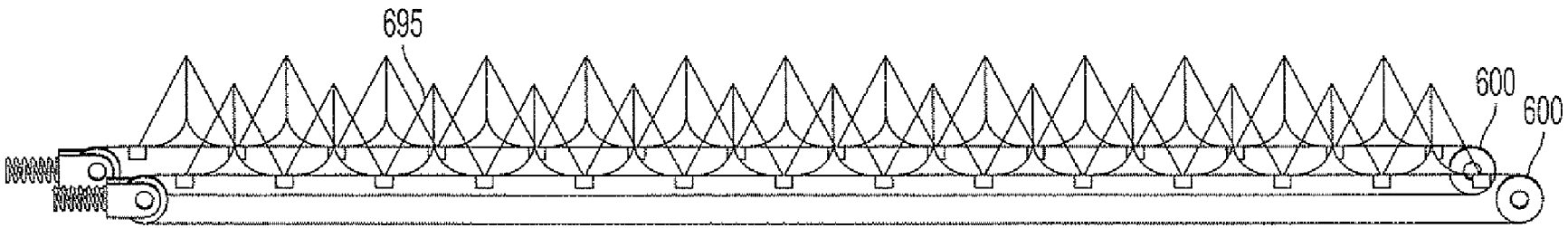
FIG. 13 illustrates a seventh exemplary embodiment showing a staggered array of two devices which are mounted in close proximity to create a direct contact of a crossover point.

Similar to FIG. 12, FIG. 13 shows an embodiment having two coronode devices 600. However, the staggered arrays of two coronode devices are mounted in close proximity to create a direct contact of the nanotubular filaments 30 at specific crossover points within the free spans of the nanotubular filaments 30. Mutual sliding contact results from the movement of the nanotubular filaments 30 in crossing directions, and the contact force created by the contact can be used to at least partially clean the silicate buildups off of the individual filaments.

Figure 14:
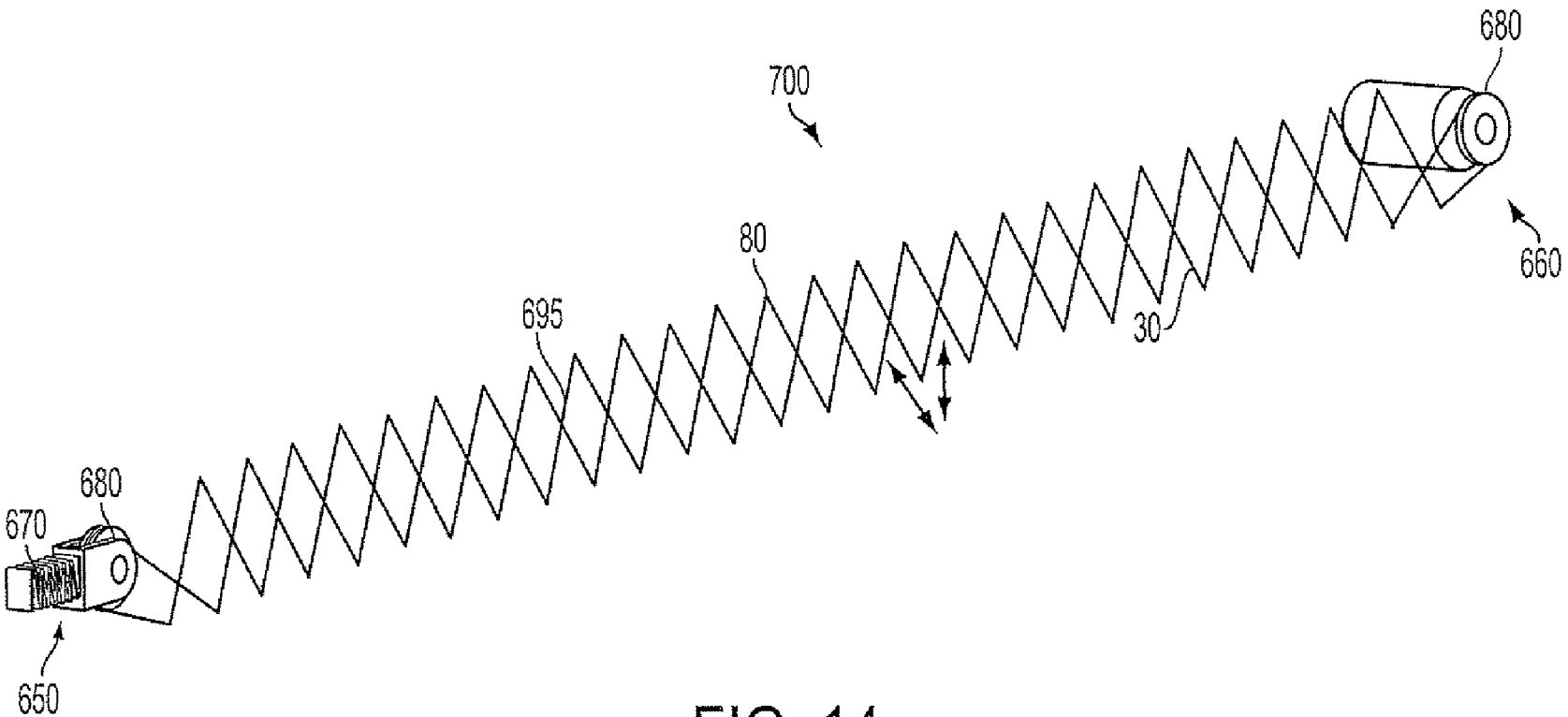
FIG. 14 illustrates an eighth exemplary embodiment of the coronode device.

FIG. 14 illustrates a coronode device 700. In this coronode device, the support structure is not shown. In the configuration of coronode device 700, a single nanowire has crossover points with itself and therefore can act as a cleaner. That is, each crossover point acts as a scraping area to scrape off silicate dendrites off of the exhausted regions that enter this intersection region. Such a configuration automatically and continuously cleans and renews the nanotubular filament. FIG. 14 illustrates a design wherein the continuous loop of filament is supported to form a linear array of opposing apexes. The top-most row of apexes comprises the active regions 80 of the nanotubular filament 30. Other regions, including the bottom-most apexes, comprise the inactive regions. The points of intersection of the portions of nanotubular filament 30 (e.g., at approximately the midpoint between top and bottom apexes) are points of contact wherein the crossing directions of the nanotubular filament 30 travel coupled with an appropriate loading mechanism (such as a spring) can be used for scraping. The wire can be twisted or the configuration adjusted so that the scraping areas cover the whole circumference of the nanotubular filament 30 by scraping multiple sides of the nanotubular filament 30.

The functional life of the active apex region of the filament is governed by the contamination accumulation kinetics (e.g., build up of silica oxide films and dendrites) which is characteristically in the range of 50,000 to 250,000 print cycles for a conventional pin coronode, depending on the customer's environment and air quality. The use of a slightly larger filament diameter and/or a suitable metal overcoat can be deployed in the event that corona erosion may occur.

The designs described above are expected to have significant cost savings and increased life attributes compared to conventional coronode devices. It is estimated that the ratio of active regions to inactive regions in a length of a one meter-long filament coronode would fall in the range of from about 1:10 to about 1:100. Thus, by using the use-and-move or the use-and-move-to-replace methodology, increases in the overall life of the filament of, e.g., 10 to 100 times are possible at a significantly lower cost. By increasing the time between replacements of the entire charge device, the service hours are reduced and/or the number of replacement parts per machine life is reduced. The described embodiments lower the amount of time the machine is non-functioning due to service or replacement of components.

It will be appreciated that various of the above disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

For example, it will also be appreciated that the present concepts and disclosures can be applied to ozone generator devices, fusing rolls, electrostatic air purification systems, or any other device that benefits from extended period corona generation. Also, they can be used in devices with a need for replenishable electrodes, such as static eliminators and electrostatic cleaners.

What is claimed is:

1. A coronode charging device used to charge a photoreceptor, the coronode charging device comprising:

a support member comprising: a rotatable shaft and an external thread disposed along the shaft in a spiral shape;

a filament disposed along the support member in a configuration that creates a plurality of active regions and a plurality of inactive regions of the filament, the active regions being simultaneously positionable adjacent the photoreceptor, and wherein the filament is wrapped around the shaft and disposed in a groove defined by the external thread;

an adjustment mechanism that moves the filament such that portions of the filament that correspond to the active regions are moved to positions that correspond to the inactive regions, and some portions of the filament that were in the inactive regions are moved to positions that correspond to the active regions; and a voltage source that applies a voltage to the filament.

2. The device of claim 1, the thread comprising flat edges that expose the wrapped filament, wherein a distance from a center of the shaft to an outer perimeter of the wrapped filament is greater than a distance from the center of the shaft to at least a part of the flat edges.

3. The device of claim 1, wherein the adjustment mechanism moves the support member.

4. The device of claim 1, wherein the active regions are closer to the photoreceptor than the inactive regions.

5. A xerography device having the device of claim 1.

6. A photocopier having the device of claim 1.

7. A coronode charging device used to charge a photoreceptor, the coronode charging device comprising:

a support member comprising: a plurality of first pivot support structures disposed closer to the photoreceptor than a plurality of second pivot support structures;

a filament disposed along the support member in a configuration that creates a plurality of active regions and a plurality of inactive regions of the filament, the active regions being simultaneously positionable adjacent the photoreceptor and wherein the active regions are at the first pivot support structures;

an adjustment mechanism that moves the filament such that portions of the filament that correspond to the active regions are moved to positions that correspond to the inactive regions, and some portions of the filament that were in the inactive regions are moved to positions that correspond to the active regions;

a voltage source that applies a voltage to the filament;

a spring;

a first wheel; and a second wheel, wherein the spring is connected to the first wheel, and the filament contacts the first and second wheels, and is held taut by action of the spring.

8. The device of claim 7, wherein the filament is a single filament that forms a continuous loop between the first wheel and the second wheel, and wherein the first pivot support structure and the second pivot support structure support the single filament such that points of intersection where the single filament contacts itself are formed, wherein movement of the single filament by the adjustment mechanism causes friction at the points of intersection to remove material that has built up on the single filament.

9. The device of claim 8, wherein each point of intersection is formed between a portion of the single filament movable in a direction toward the first wheel and a portion of the single filament movable in a direction toward the second wheel.

10. An assembly comprising two coronode charging devices, each device comprising:

a support member comprising: a plurality of first pivot support structures disposed closer to a photoreceptor than a plurality of second pivot support structures;

a filament disposed along the support member in a configuration that creates a plurality of active regions and a plurality of inactive regions of the filament, the active regions being simultaneously positionable adjacent the photoreceptor and wherein the active regions are at the first pivot support structures;

an adjustment mechanism that moves the filament such that portions of the filament that correspond to the active regions are moved to positions that correspond to the inactive regions, and some portions of the filament that were in the inactive regions are moved to positions that correspond to the active regions; and a voltage source that applies a voltage to the filament, wherein the filament of a first one of the devices directly contacts the filament of a second one of the devices at a contact point, the contact causing friction that removes material that has been built up on the filaments of the two devices.

11. An assembly comprising two coronode charging devices, each device comprising:

a support member comprising: a plurality of first pivot support structures disposed closer to a photoreceptor than a plurality of second pivot support structures;

a filament disposed along the support member in a configuration that creates a plurality of active regions and a plurality of inactive regions of the filament, the active regions being simultaneously positionable adjacent the photoreceptor and wherein the active regions are at the first pivot support structures;

an adjustment mechanism that moves the filament such that portions of the filament that correspond to the active regions are moved to positions that correspond to the inactive regions, and some portions of the filament that were in the inactive regions are moved to positions that correspond to the active regions; and a voltage source that applies a voltage to the filament, wherein:

the two devices extend in a parallel direction;

the first device and the second device are at an equal distance from the photoreceptor; and the filament of the first device contacts the filament of the second device at least one contact point, the contact causing friction that removes material that has been built up on the filaments of the first device and the second device.

12. A coronode charging device used to charge a photoreceptor, the coronode charging device comprising:

a support member;

a filament disposed along the support member in a configuration that creates a plurality of active regions and a plurality of inactive regions of the filament, the active regions being simultaneously positionable adjacent the photoreceptor, and wherein the filament directly contacts portions of the support member;

an adjustment mechanism that moves the filament such that portions of the filament that correspond to the active regions are moved to positions that correspond to the inactive regions, and some portions of the filament that were in the inactive regions are moved to positions that correspond to the active regions, wherein the adjustment mechanism moves the filament without moving the support member; and a voltage source that applies a voltage to the filament.

* * * * *